US009817348B2

(12) United States Patent
Murata et al.

(10) Patent No.: US 9,817,348 B2
(45) Date of Patent: Nov. 14, 2017

(54) ROLLER AND FIXING DEVICE

(71) Applicant: CANON KABUSHIKI KAISHA, Tokyo (JP)

(72) Inventors: Naofumi Murata, Tokyo (JP); Tomoo Akizuki, Kawasaki (JP); Shoichiro Ikegami, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/172,699

(22) Filed: Jun. 3, 2016

(65) Prior Publication Data

US 2016/0370739 A1 Dec. 22, 2016

(30) Foreign Application Priority Data

Jun. 16, 2015 (JP) ..... 2015-121103

(51) Int. Cl.
*G03G 15/20* (2006.01)

(52) U.S. Cl.
CPC ... *G03G 15/206* (2013.01); *G03G 2215/2035* (2013.01); *G03G 2215/2061* (2013.01)

(58) Field of Classification Search
CPC .. G03G 15/206; G03G 2215/2048–2215/2067
See application file for complete search history.

(56) References Cited

U.S. PATENT DOCUMENTS 5,148,226 A * 9/1992 Setoriyama ..... G03G 15/2064 219/216
5,737,679 A * 4/1998 Uehara ..... G03G 15/206 399/329
2014/0199102 A1* 7/2014 Sugawara ..... G03G 15/2057 399/333
2015/0098739 A1* 4/2015 Abe ..... G03G 15/206 399/333
2015/0160596 A1* 6/2015 Asaka ..... G03G 15/206 399/333
2015/0177654 A1* 6/2015 Arizumi ..... G03G 15/206 399/333
2015/0378286 A1* 12/2015 Yamane ..... G03G 15/206 399/333

(Continued)

FOREIGN PATENT DOCUMENTS

JP 4-44076 A 2/1992
JP 6-35356 A 2/1994

(Continued)

*Primary Examiner* — Clayton E Laballe
*Assistant Examiner* — Ruifeng Pu
(74) *Attorney, Agent, or Firm* — Fitzpatrick, Cella, Harper & Scinto

(57) ABSTRACT

The roller for use in a fixing device, includes a metal core, a first elastic layer formed on an outer side of the metal core, the first elastic layer having voids, and a second elastic layer formed on an outer side of the first elastic layer, the second elastic layer having a microhardness higher than a microhardness of the first elastic layer, in which an outer diameter of an end portion of the roller is larger than an outer diameter of a middle portion of the roller in a longitudinal direction of the roller, and in which the microhardness of the second elastic layer is 25 degrees or more and 50 degrees or less.

14 Claims, 10 Drawing Sheets

(56) References Cited

U.S. PATENT DOCUMENTS

| | | | | |
|---|---|---|---|---|
| 2016/0018765 | A1* | 1/2016 | Tamura | G03G 15/206 399/333 |
| 2016/0018766 | A1* | 1/2016 | Akiyama | G03G 15/206 399/333 |
| 2016/0062280 | A1* | 3/2016 | Kinuta | G03G 15/206 399/333 |
| 2016/0091841 | A1* | 3/2016 | Matsumoto | B32B 37/06 399/333 |

FOREIGN PATENT DOCUMENTS

| | | | |
|---|---|---|---|
| JP | 2005-10381 | A | 1/2005 |
| JP | 2012-163829 | A | 8/2012 |

* cited by examiner

ROLLER AND FIXING DEVICE

BACKGROUND OF THE INVENTION

Field of the Invention

The present invention relates to a roller, especially a pressure roller provided in a fixing device in image forming apparatus such as electrophotographic copying machines and electrophotographic printers, and to a fixing device including the roller.

Description of the Related Art

In related-art image forming apparatus, for example, a film heating system has been widely used in a fixing device configured to fix an unfixed image (toner image), which is formed and borne on a recording material, onto a surface of the recording material under heating.

The fixing device includes a heater serving as a heating member, a fixing film serving as a flexible rotary member configured to rotate while being heated in contact with the heater, and a pressure roller serving as a pressure member forming a fixing nip portion with the heater through intermediation of the fixing film. A recording material having an unfixed toner image borne thereon is introduced between the fixing film and the pressure roller in the fixing nip portion, and is nipped and conveyed simultaneously with the fixing film to fix the unfixed toner image onto a surface of the recording material while heat is applied from the heater through the fixing film and pressure is applied at the fixing nip portion.

However, in such a related-art heating fixing device adopting the film heating system, when a sheet being a recording material passes through the fixing device, wrinkles may be formed on the sheet at the fixing nip portion due to temperature unevenness in a longitudinal direction of the pressure roller and unevenness of a sheet conveyance speed at the fixing nip portion in the longitudinal direction of the pressure roller.

The structure in which a radially outer portion of a pressure roller has a reverse camber shape as disclosed in Japanese Patent Application Laid-Open No. H04-44076 is known to deal with the wrinkles of the recording material. With this structure, a circumferential speed of the pressure roller becomes higher at both end portions than in a middle portion. In other words, sheet conveyance force is set to be larger at the ends than in the middle to pull a sheet outward so as to prevent slack from being formed in the middle of the sheet, thus suppressing formation of the wrinkles.

Incidentally, it is effective to use an elastic sponge rubber layer formed by foaming silicone rubber so that a pressure roller has a heat insulating effect, or to use a void-containing elastic layer having an enhanced heat insulating effect through dispersion of a hollow filler (microballoons) in a silicone rubber layer so that a cured product contains gaseous portions.

However, when a roller main body of the pressure roller using the void-containing elastic layer has a reverse camber longitudinal shape, there is a problem in that a difference in sheet conveyance speed between a middle portion and end portions in the longitudinal direction of the roller main body does not occur, thus hindering stable control of sheet conveyance to cause formation of wrinkles. In other words, in a void-containing rubber elastic material such as sponge rubber, rubber itself has a large elasticity, and hence a difference in sheet conveyance force between the middle portion and the end portions is absorbed due to deformation of the rubber so that the void-containing rubber elastic material hardly affects behavior of a sheet.

SUMMARY OF THE INVENTION

According to a first aspect of the present invention, there is provided a roller for use in a fixing device, the roller including: a metal core; a first elastic layer formed on an outer side of the metal core, the first elastic layer having voids; and a second elastic layer formed on an outer side of the first elastic layer, the second elastic layer having a microhardness higher than a microhardness of the first elastic layer, in which an outer diameter of an end portion of the roller is larger than an outer diameter of a middle portion of the roller in a longitudinal direction of the roller, and in which the microhardness of the second elastic layer is 25 degrees or more and 50 degrees or less.

According to a second aspect of the present invention, there is provided a fixing device configured to heat, at a nip portion, a recording material being conveyed and having a toner image formed thereon so as to fix the toner image onto the recording material, the fixing device including: a heating member to be brought into contact with the toner image; and a roller forming the nip portion with the heating member, the roller having a larger outer diameter in a longitudinal direction of the roller in an end portion than in a middle portion, the roller including: a metal core; a first elastic layer formed on an outer side of the metal core; and a second elastic layer formed on an outer side of the first elastic layer, in which the first elastic layer includes a layer having voids, and in which the second elastic layer has a microhardness of 25 degrees or more and 50 degrees or less.

Further features of the present invention will become apparent from the following description of exemplary embodiments with reference to the attached drawings.

DESCRIPTION OF THE EMBODIMENTS

Figure 1:
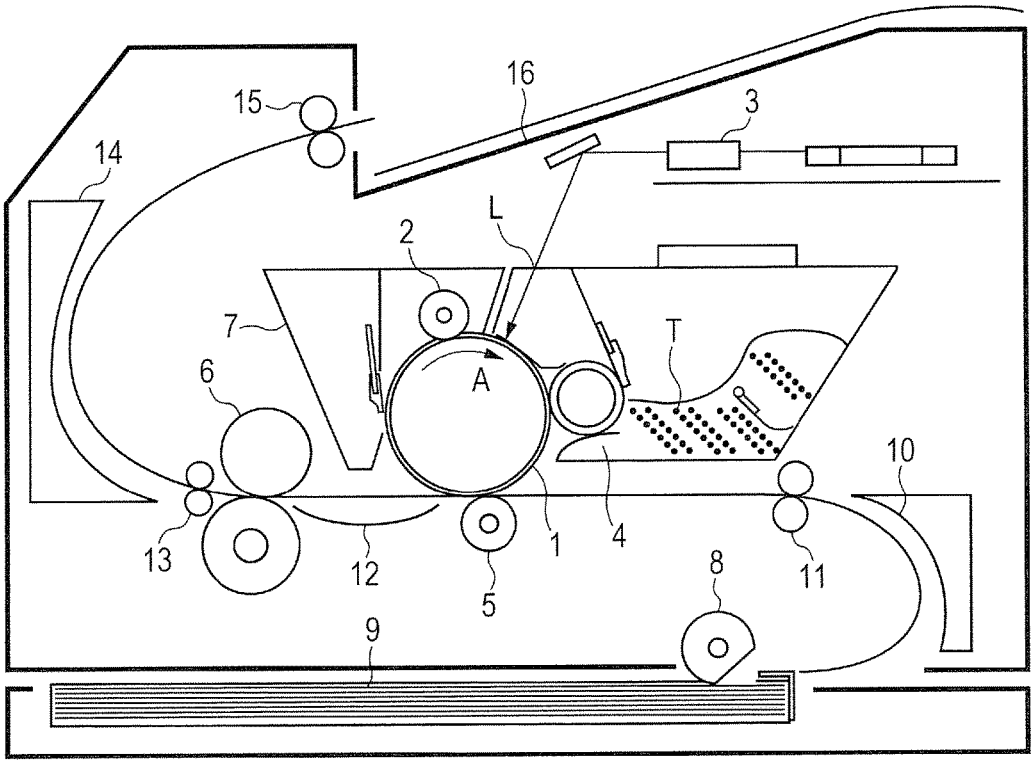
FIG. 1 is a cross-sectional view of an image forming apparatus according to a first embodiment of the present invention.

Now, the present invention is described in detail with reference to embodiments shown in the drawings.

First Embodiment

<Image Forming Apparatus>

The overall structure of an image forming apparatus to which the present invention is applied is first simply described with reference to FIG. 1.

The image forming apparatus is a laser beam printer using a transfer type electrophotographic process, and includes a rotary drum type electrophotographic photosensitive member (hereinafter referred to as "photosensitive drum 1") serving as an image bearing member. The photosensitive drum 1 is driven to rotate at a predetermined circumferential speed (process speed) in a clockwise direction indicated by the arrow A. The photosensitive drum 1 has the structure obtained by forming a photosensitive material layer made of OPC, amorphous Se, or amorphous Si on an outer peripheral surface of a cylindrical (drum-shaped) conductive base made of aluminum or nickel.

The photosensitive drum 1 is uniformly charged by a charging roller 2 serving as a charging unit to predetermined polarity and potential in a rotation process of the photosensitive drum 1. The uniformly charged surface of the photosensitive drum 1 is subjected to scanning exposure by a scanner 3 using a laser beam L which is modulation-controlled (ON/OFF controlled) in accordance with image information. An electrostatic latent image of the image information concerned is formed on the surface of the photosensitive drum 1. Then, the electrostatic latent image formed on the photosensitive drum 1 is developed into a visible image with toner T in a developing device 4. Exemplary development processes that may be used include a jumping development process, a two-component development process, and a FEED process. For example, image exposure and reversal development are used in combination.

Meanwhile, recording materials P received in a sheet feed cassette 9 are fed out one by one through drive of a sheet feed roller 8 and conveyed along a sheet path having a guide 10 and registration rollers 11. The sheets being conveyed are then conveyed at a predetermined control timing to a transfer nip portion serving as a pressure contact portion between the photosensitive drum 1 and a transfer roller 5. Then, toner images on the surface side of the photosensitive drum 1 are sequentially transferred to surfaces of the recording materials P.

The above-mentioned photosensitive drum 1, charging roller 2, scanner 3, developing device 4, and transfer roller 5 construct an image forming part configured to form toner images on the recording materials P.

The recording materials that pass through the transfer nip portion are sequentially separated from the surface of the photosensitive drum 1 to be introduced by a conveyance device 12 to a fixing device 6 serving as a heating device, and then subjected to a toner image heat fixing process. The fixing device 6 is described in detail in the next section.

The recording materials P that pass through the fixing device 6 pass along a sheet path having conveyance rollers 13, a guide 14 and sheet delivery rollers 15 to be delivered to a sheet delivery tray 16.

The surface of the photosensitive drum 1 after separation of the recording materials is subjected to a removal process for adhering contaminants such as toner remaining after transfer in a cleaning device 7 to clean the surface, and the surface of the photosensitive drum 1 is repeatedly used for image formation.

<Fixing Device>

Next, a pressure roller and the fixing device serving as the heating device, which are features of the present invention, are described in detail with reference to FIG. 2.

The fixing device 6 is a fixing device of a so-called tensionless type film heating and pressure roller drive system. In other words, the fixing device 6 includes a heating rotary member 20 serving as a heating member, and a pressure roller 21 having a roller main body configured to be brought into pressure contact with the heating rotary member 20 to form a fixing nip portion N serving as a heating nip portion. The fixing device 6 is configured to heat the recording material P serving as a material to be heated at the fixing nip portion N while nipping and conveying the recording material P.

The heating rotary member 20 includes a heater 19 serving as a heating member, a flexible fixing film 201 configured to rotate while being heated in contact with the heater 19, and a film guide member 18 configured to support the heater 19 while guiding the fixing film 201. The heating rotary member 20 further includes a fixing stay 22 configured to uniformly transmit pressure received at both longitudinal ends in a longitudinal direction of the film guide member 18.

The heater 19 is in pressure contact with the pressure roller 21 through intermediation of the fixing film 201 with a predetermined pressing force applied to the pressure roller 21 in a state in which the heater 19 is held by the film guide member 18. Then, when the pressure roller 21 rotates, rotative force acts on the fixing film 201 due to sliding frictional force between the pressure roller 21 and an outer surface of the fixing film 201 to cause the fixing film 201 to rotate in an arrow direction on an outer periphery of the film guide member 18 holding the heater 19.

Figure 2:
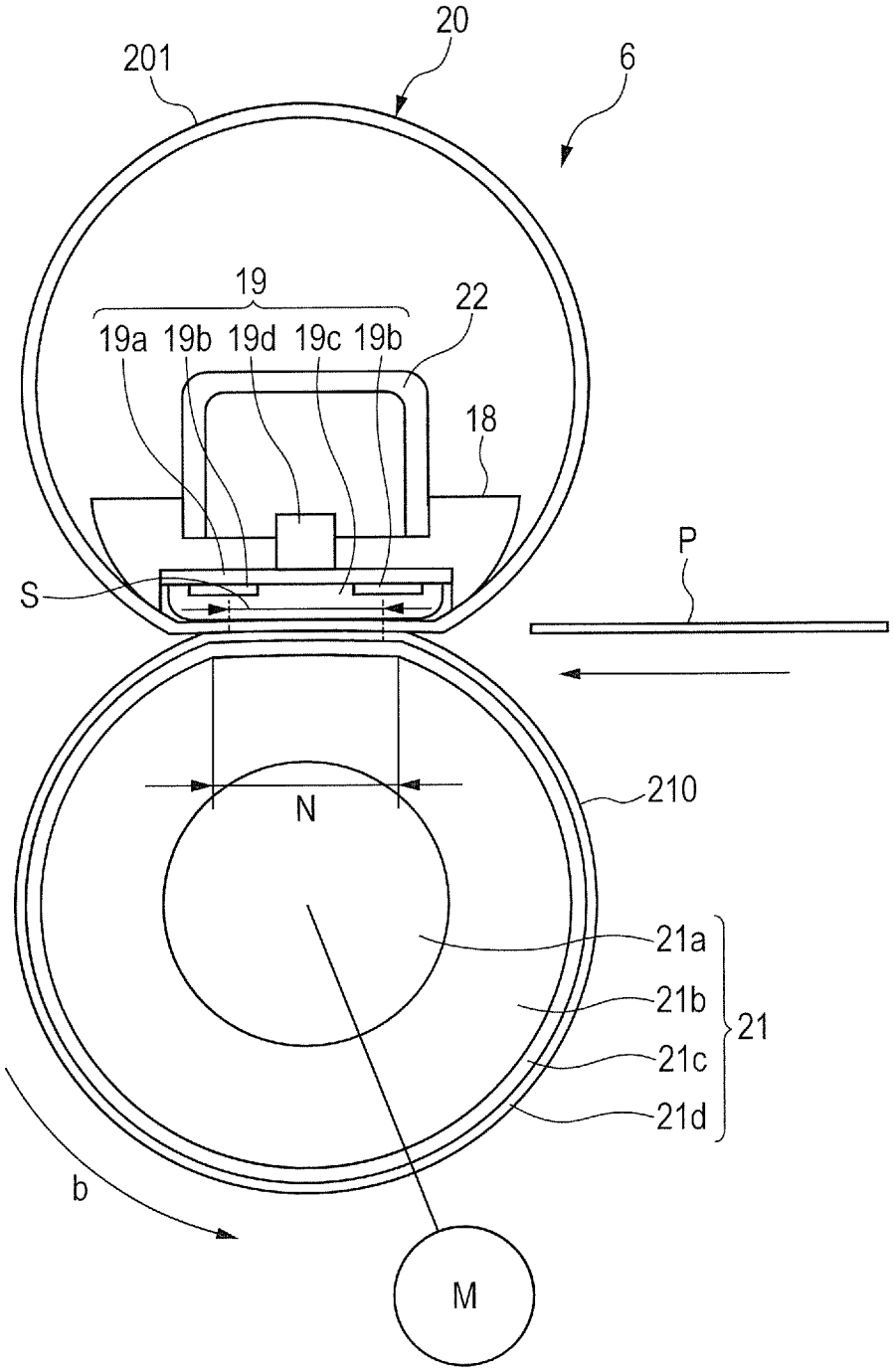
FIG. 2 is an enlarged schematic cross-sectional view of a fixing device in FIG. 1.

The film guide member 18 is an elongated member which is substantially semicircular in cross section and in the shape of a gutter with its longitudinal direction being perpendicular to the drawing sheet of FIG. 2. The film guide member 18 is molded, for example, as a molded product of a heat-resistant resin such as polyphenylene sulfide (PPS) or liquid crystal polymer.

The heater 19 is an elongated plate member and is received and held in grooves formed longitudinally in a substantially middle portion on a lower surface of the film guide member 18. The heater 19 is a low heat capacity ceramic heater including an elongated laminar substrate 19*a* made of alumina or AlN and a linear or narrow band-shaped Ag/Pd conductive heating element (resistance heating element) 19*b* formed longitudinally on a surface side (film sliding surface side) of the substrate 19*a*. The resistance heating element 19*b* is coated with a glass coating layer 19*c*, and a thermometric element 19*d* such as a thermistor is arranged on a back surface side of the substrate 19*a*. The heater 19 is controlled so as to rapidly elevate the temperature through supply of electric power from an electrode (not shown) for the resistance heating element 19*b* and then maintain a predetermined fixing temperature (control temperature) through an electric power control system including the thermometric element 19*d*.

The fixing film 201 is an endless belt-shaped heat-resistant film loosely wrapped around the film guide member 18. An inner surface of the fixing film 201 is in sliding contact with the glass coating layer 19*c* on a surface of the heater 19. Grease serving as a lubricant is applied to a surface of the glass coating layer 19*c* (surface of the heater 19) to reduce the sliding resistance.

The fixing film 201 is a composite layer film having a total film thickness of 400 μm or less, preferably 30 μm or more and 300 μm or less to improve quick start properties of the device through reduction of the heat capacity.

A base layer of the fixing film 201 is formed by using, singly or in combination, heat-resistant resins such as polyimide, polyamide-imide, and PEEK, or members of metals having heat resistance and high thermal conductivity, such as SUS, Al, Ni, Ti, and Zn. An elastic layer for improving the toner fixing performance may be formed on the base layer, and silicone rubber and fluororubber containing a thermally conductive filler or a reinforcing material added thereto are suitably used. A main polymer of a fixing film release layer includes fluororesin, and may contain a conductive member made of carbon black or an ion conductive substance when necessary.

The pressure roller 21 is driven to rotate in a counterclockwise direction indicated by the arrow b at least during execution of image formation. The fixing film 201 follows the rotation of the pressure roller 21. More specifically, when the pressure roller 21 is driven, rotative force acts on the fixing film 201 due to frictional force between the pressure roller 21 and the outer surface of the fixing film 201 at the fixing nip portion N. During rotation of the fixing film 201, the inner surface of the fixing film slides in close contact with the glass coating layer 19*c* serving as a surface protective layer of the heater 19 at the fixing nip portion N. The fixing nip portion N is formed between the pressure roller 21 and the heater 19 through elastic deformation of the elastic layer of the pressure roller 21 brought into pressure contact with the heater 19 through intermediation of the fixing film 201.

Driving force from a drive source M is transmitted through a driving force transmission mechanism such as a gear (not shown) to the pressure roller 21 so that the pressure roller 21 is driven to rotate in the counterclockwise direction indicated by the arrow b at a predetermined circumferential speed.

The fixing stay 22 uses rigid materials such as iron, stainless steel, SUM, and zinc-coated steel, and the rigidity is enhanced by adopting a U-shaped cross-sectional shape.

The recording material P is nipped and conveyed through the fixing nip portion N to heat and fix the toner image on the recording material P. Then, the recording material P that passes through the fixing nip portion N is separated from the outer surface of the fixing film 201 and conveyed. Further, substantially no tension acts on the other part of the rotating fixing film 201 than the fixing nip portion N, and a flange member (not shown) configured to simply receive end portions of the fixing film 201 is only arranged as a restriction member configured to restrict film displacement.

[Structure of Pressure Roller]

Next, the pressure roller, which is the feature of the present invention, is described in detail.

The pressure roller 21 includes a metal core 21*a* which is a circular shaft base made of iron or aluminum, and a foamed elastic layer 21*b* having heat insulating properties and serving as a first elastic layer formed on an outer periphery of the metal core 21*a*, and a layer 21*c* having high hardness (hereinafter referred to as "high hardness layer 21*c*") is arranged on an outer periphery of the elastic layer 21*b*. The pressure roller 21 has three-layer laminated structure further including a heat-resistant release layer 21*d* made of fluororesin such as PFA, PTFE, or FEP and serving as an outermost surface layer formed on the high hardness layer 21*c*. Those layers construct a roller main body 210 having rubber-like elasticity as a whole and form the fixing nip portion N which is in pressure contact with the fixing film 201.

According to this embodiment, the high hardness layer 21*c* being the intermediate layer is a second elastic layer which is harder than the elastic layer 21*b*, and is deformed in a state in which there is no change in circumferential length when pressure is applied at the fixing nip portion N. The release layer 21*d* may also be adjusted to form a second elastic layer having high hardness.

The elastic layer 21*b* is an elastic layer (void-containing layer) formed by insulation through foaming of silicone rubber containing resin microballoons in order to improve the quick start properties, and desirably has a thickness of from 2 mm to 10 mm. The elastic layer 21*b* used to examine the effect according to this embodiment has a thickness of 3.5 mm in a middle portion in a longitudinal direction of the pressure roller 21.

In order to increase the microhardness at a surface of the pressure roller 21, the high hardness layer 21*c* is molded using heat-resistant silicone rubber or silicone rubber oriented by containing carbon fibers. Further, an adhesive layer configured to bond the release layer 21*d* to the elastic layer 21*b* may serve as the high hardness layer 21*c*.

Although described later in detail, the high hardness layer 21*c* desirably has a microhardness of 25 degrees or more in terms of suppression of wrinkles and desirably has a microhardness of 50 degrees or less in terms of conveyance force of the recording material P.

Figure 3A:
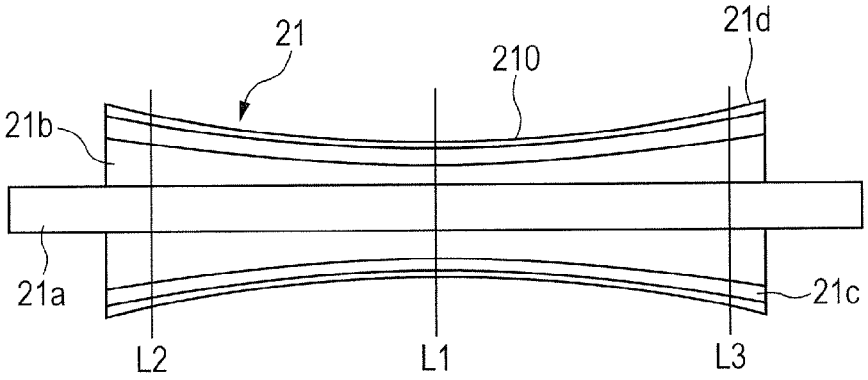
FIG. 3A is a cross-sectional view taken along a plane passing through a central axis of a pressure roller in FIG. 2.

FIG. 3A is an illustration of a cross-section in the longitudinal direction of the pressure roller 21.

The metal core 21*a* of the pressure roller 21 is longer than the roller main body 210, and both ends of the metal core 21*a* protrude from the roller main body 210 in the longitudinal direction. The roller main body 210 has, in its longitudinal direction, a shape in which its diameter on both end sides in the longitudinal direction is larger than that in the middle portion, and in the illustrated example, a reverse camber shape in which its outer diameter is gradually increased from the middle portion to both end portions in the longitudinal direction of the pressure roller 21.

When a middle position in the longitudinal direction is denoted by L1, and one end position and the other end position of the end portions in the longitudinal direction are denoted by L2 (left end in FIG. 3A) and L3 (right end in FIG. 3A), respectively, a reverse camber amount is set by a distance Lo between the middle position L1 and the left end L2 or between the middle position L1 and the right end L3 and an outer diameter difference 6 between the middle position L1 and the left end L2 or between the middle position L1 and the right end L3. In this embodiment, for example, Lo and δ are set to 100 mm and 150 μm, respectively, and the roller main body 210 has such a shape that a portion from the middle position L1 to the left end L2 and a portion from the middle position L1 to the right end L3 are connected in a parabolic shape.

Figure 3B:
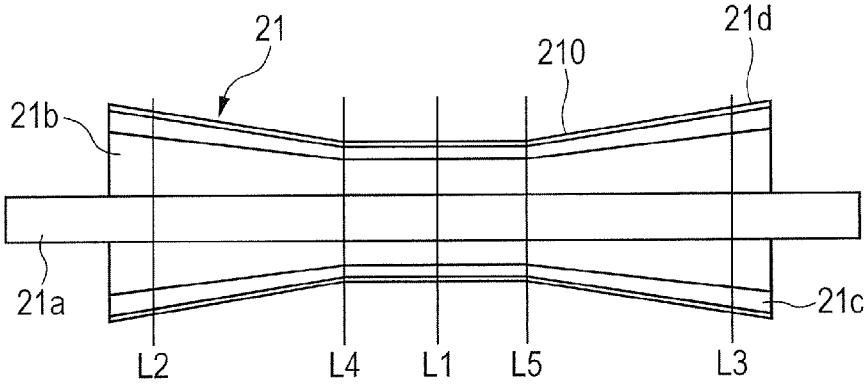
FIG. 3B is a cross-sectional view of a modified example of the pressure roller illustrated in FIG. 3A.

The longitudinal shape of the roller main body 210 is not limited to the parabolic shape, but may be a tapered shape, as illustrated in FIG. 3B. When one intermediate position and the other intermediate position in the longitudinal direction at which the diameter is equal to that at the middle position L1 are denoted by L4 (left intermediate position) and L5 (right intermediate position), respectively, a distance between the left intermediate position L4 and the right intermediate position L5 is 30 mm. When the respective points at the left intermediate position L4, the middle position L1, and the right intermediate position L5 are connected together, a straight outer diameter shape is obtained, and an outer diameter difference between respective portions at the left intermediate position L4, the middle position L1, and the right intermediate position L5 on one hand, and the left end L2 and the right end L3 on the other is 150 μm.

In FIG. 3A and FIG. 3B, the high hardness layer 21*c* and the release layer 21*d* are each formed so as to have a uniform radial thickness over the entire length in the longitudinal direction, and the outer periphery of the elastic layer 21*b* which forms a boundary surface between the high hardness layer 21*c* and the elastic layer 21*b* has a reverse camber shape similar to an outer peripheral shape of the roller main body 210. The high hardness layer 21*c* has a thickness set to 150 μm, for example.

<Wrinkle-Suppressing Mechanism>

Next, a mechanism in which the reverse camber shape causes a wrinkle-suppressing effect when the pressure roller 21 includes the high hardness layer 21*c* according to the first embodiment is described by comparison with a pressure roller using void-free rubber and a pressure roller without the high hardness layer 21*c*.

Figure 6A:
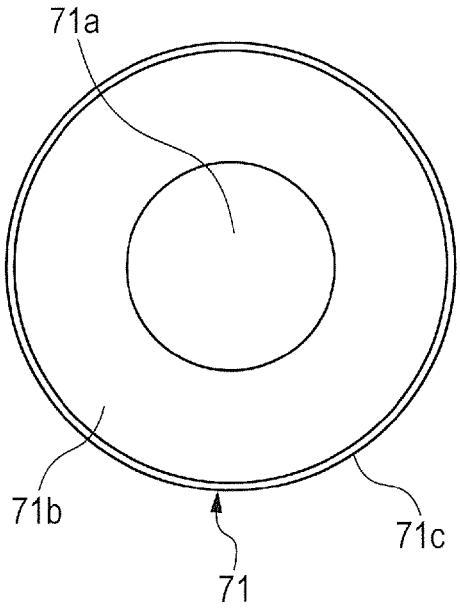
FIG. 6A and FIG. 6B are reference views for illustrating the mechanism of the operations and effects of the pressure roller according to this embodiment.
Figure 6B:
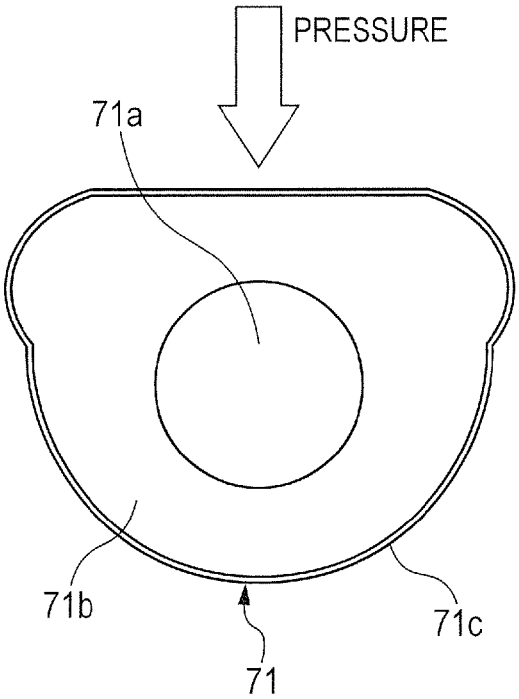

FIG. 6A is a schematic cross-sectional view of a pressure roller 71 to which no pressure is applied, using void-free rubber (hereinafter referred to as "solid rubber") in the elastic layer. FIG. 6B is a schematic cross-sectional view of the pressure roller 71 in a state in which pressure is applied.

When pressure is applied to the pressure roller 71 at the fixing nip portion N, a pressure-applied portion of an elastic layer 71*b* is crushed and deformed. However, the elastic layer 71*b* is deformed so that a pressure-free portion expands by a magnitude corresponding to the crushed part, and hence there is substantially no change in circumferential length of the pressure roller 71 even when pressure is applied. Therefore, even when pressure is applied to the pressure roller 71, its circumferential length is maintained, and the pressure roller 71 having the reverse camber shape causes a difference in conveyance force between the middle portion and the end portions in the longitudinal direction even during application of pressure, thereby obtaining a wrinkle-suppressing effect.

Figure 7A:
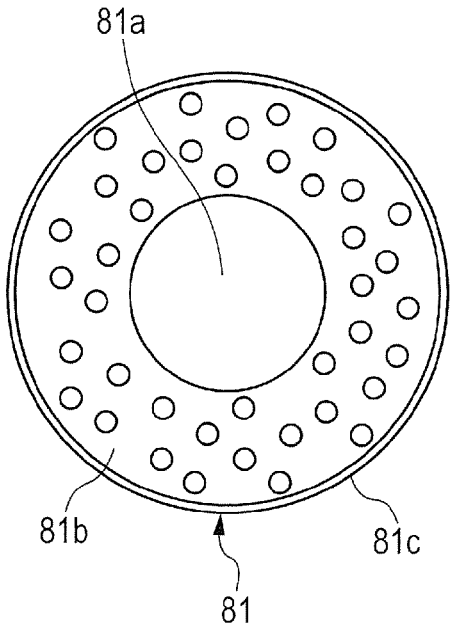
FIG. 7A and FIG. 7B are reference views for illustrating the mechanism of the operations and effects of the pressure roller according to this embodiment.
Figure 7B:
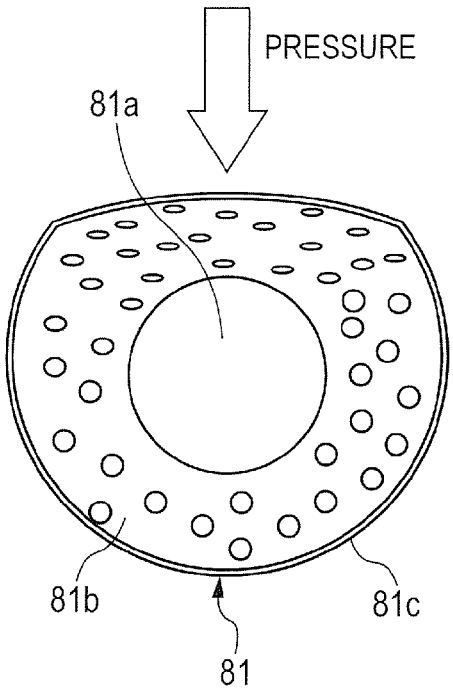

FIG. 7A is a schematic cross-sectional view of a pressure roller 81 to which no pressure is applied, with no high hardness layer but only with an elastic layer 81*b* using void-containing rubber and a release layer 81*c*. FIG. 7B is a schematic cross-sectional view of the pressure roller 81 in a state in which pressure is applied.

When pressure is applied to the pressure roller 81, a pressure-applied portion of the elastic layer 81*b* is crushed and deformed but deformation of a pressure-free portion is small unlike the solid rubber, and hence a circumferential length of the pressure roller 81 is shortened by a magnitude corresponding to the crushed part when pressure is applied thereto. Particularly when the pressure roller 81 has the reverse camber shape, the end portions each have a large outer diameter and tend to be more easily crushed than the middle portion in the longitudinal direction, and hence a difference in circumferential length between the middle and the end portions becomes smaller.

Therefore, when pressure is applied to the pressure roller 81, its circumferential length is changed, and hence a desired difference in conveyance force between the middle portion and the end portions in the longitudinal direction is not easily obtained even when the pressure roller 81 has the reverse camber shape, and the wrinkle-suppressing effect is small.

Figure 4A:
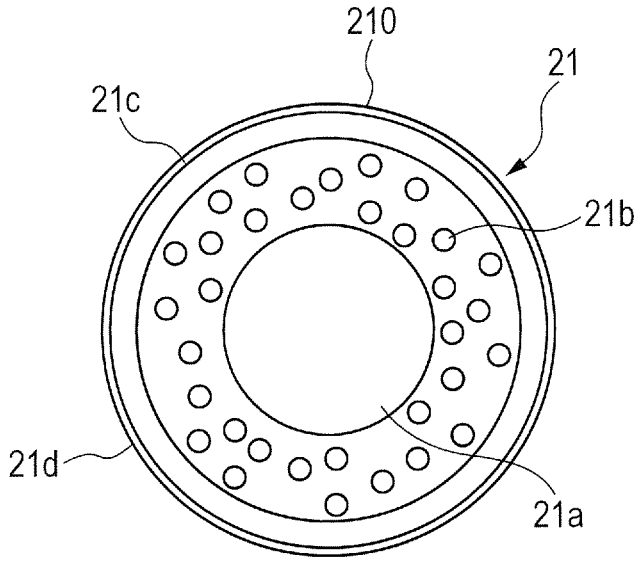
FIG. 4A and FIG. 4B are views for illustrating a mechanism of operations and effects of the pressure roller according to this embodiment.
Figure 4B:
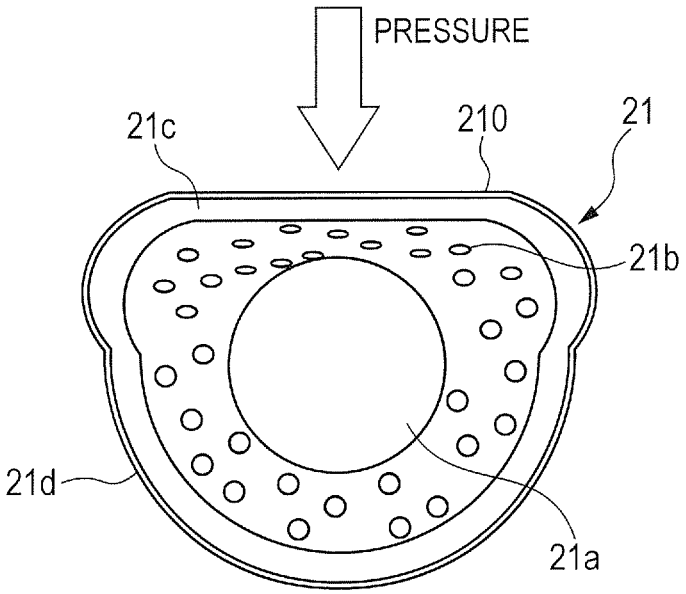

FIG. 4A is a schematic cross-sectional view of the pressure roller according to this embodiment, that is, the pressure roller 21 to which no pressure is applied, with the high hardness layer 21*c* on the outer periphery of the elastic layer 21*b*. FIG. 4B is a schematic cross-sectional view of the pressure roller 21 in a state in which pressure is applied.

Figure 5:
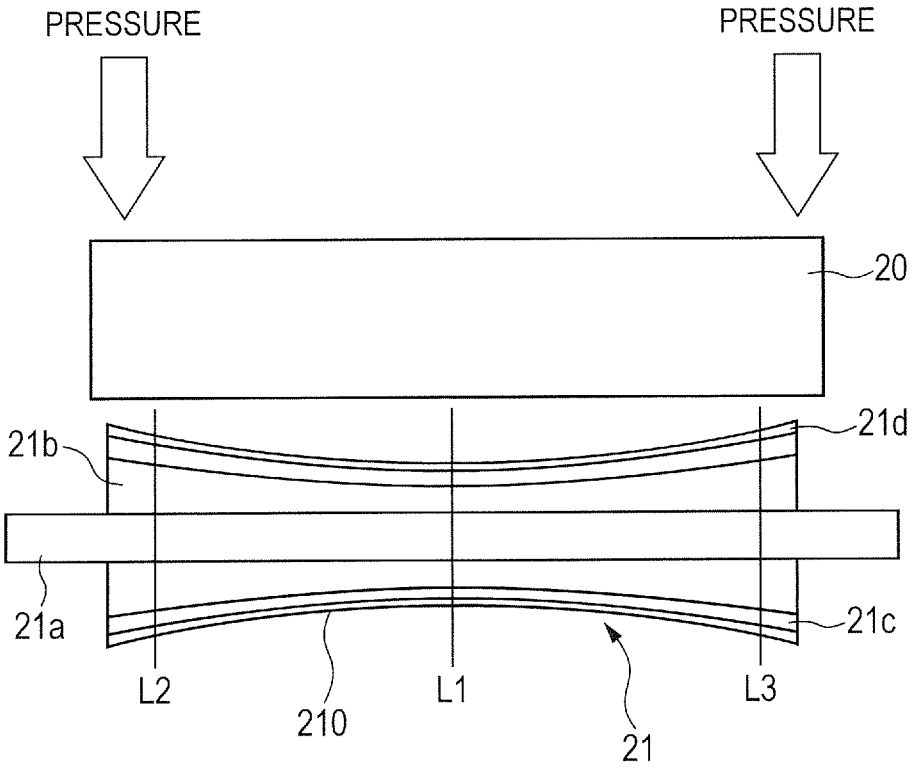
FIG. 5 is a view for illustrating a relationship between a cross-section in a longitudinal direction of the pressure roller in FIG. 4A and FIG. 4B and a heating member.

When pressure is applied to the pressure roller 21 at the fixing nip portion at which the pressure roller 21 is in contact with the heating rotary member 20 (see FIG. 5), as illustrated in FIG. 4A and FIG. 4B, a pressure-applied portion of the elastic layer 21*b* is crushed to deform the elastic layer 21*b* and the high hardness layer 21*c*. However, the high hardness layer 21*c* which is harder than the elastic layer 21*b* plays a role like a shell and exhibits such a behavior similar to that of the solid rubber as to maintain the circumferential length even in a pressure-free portion. Therefore, there is substantially no change in the circumferential length of the pressure roller 21 even when pressure is applied thereto.

Accordingly, the circumferential length is likely to be maintained as in the solid rubber, and the desired difference in conveyance force of the recording material P between the middle and the end portions in the longitudinal direction is easily obtained owing to the reverse camber shape, thus achieving the wrinkle-suppressing effect.

Next, results of a wrinkle measurement experiment performed to examine the effect according to this embodiment are described below.

<Method of Examining Operations and Effects>

Operations and effects were examined by measuring wrinkles when a microhardness value of the high hardness layer 21*c* of the pressure roller 21 was varied, and also measuring the difference in recording material conveyance force between the middle and the end portions in the longitudinal direction of the pressure roller 21 when the microhardness value of the high hardness layer 21*c* was varied.

The microhardness of the high hardness layer 21*c* was measured using a microhardness tester (product name: MD-1, manufactured by Kobunshi Keiki Co., Ltd.). In this embodiment, the release layer 21*d* is used, and hence at the time of measurement of the microhardness, the release layer 21*d* was peeled off before measurement.

The microhardness of the high hardness layer 21*c* was varied by changing an amount of carbon fibers (fiber length: 250 μm) serving as a fiber-based filler (fibrous filler) to be contained in the high hardness layer 21*c*.

Figure 8:
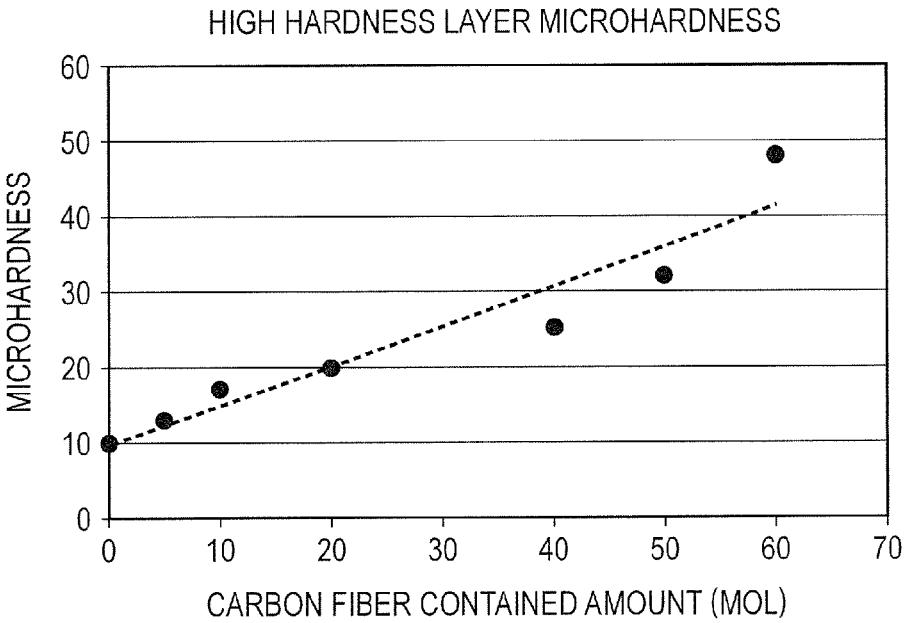
FIG. 8 is a graph for showing a relationship between a microhardness of a high hardness layer according to the first embodiment and a carbon fiber contained amount.

A relationship between the microhardness of the high hardness layer 21*c* used in this embodiment and a carbon fiber contained amount is shown in FIG. 8.

This graph indicates that the microhardness of the high hardness layer 21*c* is increased more as the carbon fiber contained amount becomes larger. As understood from the graph, the microhardness of the high hardness layer 21*c* is in a preferred range of from 25 degrees to 50 degrees when the carbon fiber contained amount is in a range of from 40 mols to 60 mols.

As for wrinkle evaluation, print sampling was started from a state in which the fixing device was at normal temperature, and 200 recording materials [Business 4200 (trade name, manufactured by Xerox Corporation) were continuously printed. Then, whether or not wrinkles were formed was verified. Cases where no wrinkles were formed were rated as PASS, and cases where wrinkles were formed were rated as FAIL. Evaluation results are shown in Table 1.

TABLE 1

| MICROHARDNESS | EVALUATION RESULT |
|---|---|
| 15 | FAIL |
| 18 | FAIL |
| 22 | FAIL |
| 25 | PASS |
| 28 | PASS |
| 36 | PASS |
| 48 | PASS |
| COMPARATIVE EXAMPLE 1 | PASS |

As understood from Table 1, cases where the microhardness was 25 degrees or more were all rated as PASS, and cases where the microhardness was 22 degrees or less were all rated as FAIL. As understood from those results, formation of wrinkles can be suppressed at a microhardness of 25 degrees or more.

The difference in recording material conveyance force between the middle and the end portions in the longitudinal direction of the pressure roller 21 was evaluated by measuring a sheet open amount indicating a force of pulling a recording material toward both end portions in the longitudinal direction of the pressure roller 21.

Measurement of the sheet open amount is first described with reference to FIG. 9.

Figure 9:
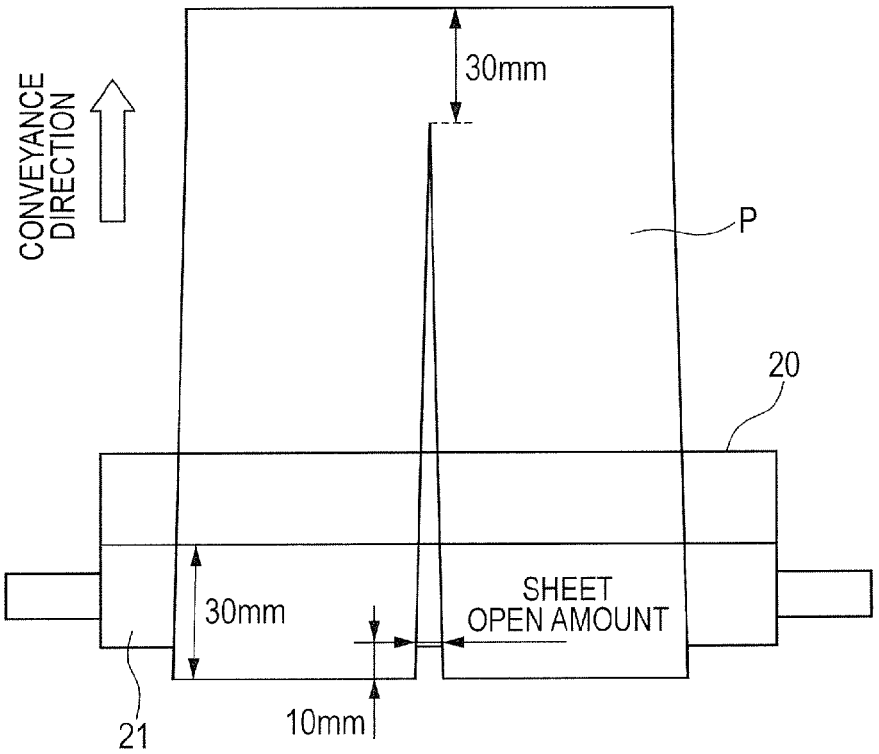
FIG. 9 is a view for illustrating a method of examining the operations and effects according to the first embodiment.

As illustrated in FIG. 9, a slit was formed in a recording material P [Business 4200 (trade name, manufactured by Xerox Corporation)] from a middle position in the width of the recording material 30 mm away from the leading edge of the recording material P to the trailing edge in the conveyance direction of the recording material, and the recording material P was caused to pass through the fixing device 6 from the side having no slit. Conveyance was stopped immediately before a position 30 mm away from the trailing edge in the conveyance direction of the recording material entered the nip portion of the fixing device, and the open amount of the slit of the recording material was measured at a position 10 mm away from the trailing edge in the conveyance direction of the recording material.

As Comparative Example 1, the pressure roller 71 using the solid rubber (shape: same reverse camber shape as in this embodiment, thickness in the middle portion in the longitudinal direction of the elastic layer 71*b:* 3.5 mm, no high hardness layer was formed, the release layer 71*c* was formed, microhardness of the elastic layer 71*b* when the release layer was peeled: 30 degrees) was also subjected to measurement.

Figure 10:
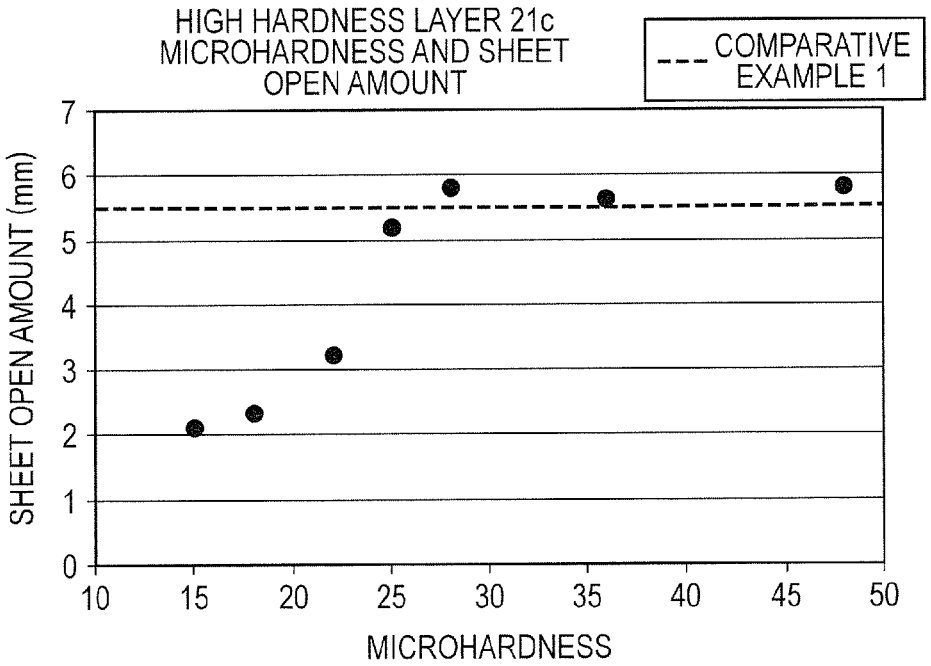
FIG. 10 is a graph for showing sheet open amount measurement results according to the first embodiment.

Sheet open amount measurement results are shown in FIG. 10.

As understood from those results, the sheet open amount is increased more as the microhardness becomes higher, and the sheet open amount sharply increases in the vicinity of 25 degrees or more. The sheet open amount in Comparative Example 1 indicated by a broken line in the graph is 5.7 mm and is substantially equivalent to that at the microhardness of 25 degrees or more. Thus, it can be understood that when the microhardness is 25 degrees or more, a difference in recording material conveyance force between the middle and the end portions in the longitudinal direction of the pressure roller is obtained to the extent that wrinkles can be suppressed.

As described above, as understood from the results shown in Table 1 and FIG. 10, the wrinkle-suppressing effect is obtained at a microhardness of 25 degrees or more. However, when the microhardness is high, there is a risk of reduction of sheet conveyance force. When the microhardness is high, sheet gripping force at the surface of the pressure roller decreases, and particularly a sheet in a high humidity environment or a sheet having a high moisture absorption rate generates water vapor during passage through the fixing device to cause water droplets to be formed on the surface of the pressure roller. As a result, the sheet may slip.

Results of slippage examined when the microhardness was varied are shown in Table 2 (examination results of sheet conveying properties in the first embodiment).

TABLE 2

| MICROHARDNESS | EVALUATION RESULT |
|---|---|
| 30 | PASS |
| 36 | PASS |
| 48 | PASS |
| 50 | PASS |
| 52 | FAIL |
| 58 | FAIL |
| 60 | FAIL |

As for the examination method, a sheet which was left in an environment of a temperature of 32 degrees C. and a humidity of 85% for 48 hours (basis weight: 60 g/m$^2$, product name: GF-600, Canon Inc.) was caused to pass through the fixing device. Cases where the sheet was able to be conveyed without slippage were rated as PASS, and cases where the sheet was not able to be conveyed because of slippage were rated as FAIL.

As understood from the evaluation results, slippage occurs with the pressure roller 21 having a microhardness of 52 degrees or more. Therefore, the gripping force decreases at a microhardness of more than 50 degrees, and hence the high hardness layer 21*c* desirably has a microhardness of 50 degrees or less.

It can be verified from the above-mentioned examination results that the microhardness of the high hardness layer 21*c* is desirably in a range of about 25 degrees or more and 50 degrees or less, and the pressure roller 21 can suppress wrinkles of the recording material without any problem when the microhardness is in this range.

Figure 3C:
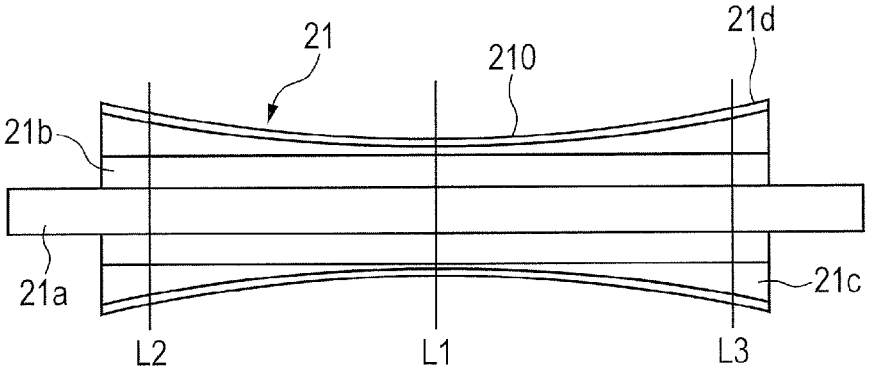
FIG. 3C is a cross-sectional view of a modified example of the pressure roller illustrated in FIG. 3A.

The thickness of the high hardness layer 21*c* in the first embodiment is uniform in the longitudinal direction. However, the high hardness layer 21*c* may have the structure described in FIG. 3C. In other words, the elastic layer 21*b* of the pressure roller 21 has a straight shape, but the thickness of the high hardness layer 21*c* is increased from the middle portion toward the ends in the longitudinal direction. With this structure, the microhardness of the high hardness layer 21*c* is increased at the ends, and the circumferential length in the vicinities of the end portions are more easily maintained than in the middle portion. Thus, wrinkles may be suppressed because the difference in conveyance force between the middle and the end portions in the longitudinal direction is more likely to occur.

The heat insulating effect in the end portions of the pressure roller is decreased correspondingly to the thickness increased in the end portions, and hence there is a risk in that the fixing performance in image end portions may be degraded, and the thickness is suitably selected based on the balance between the wrinkle-suppressing effect and the fixing performance.

Second Embodiment

Next, a second embodiment of the present invention is described.

The second embodiment is the same as the first embodiment in the structure of each of the image forming apparatus and the fixing device except for the structure of the pressure roller which is only a difference therebetween. Therefore, the structure of the pressure roller is only given in the following description, and descriptions of the structure of each of the image forming apparatus and the fixing device are omitted.

According to the first embodiment, the microhardness of the high hardness layer 21*c* itself of the pressure roller is defined. However, according to the second embodiment, the microhardness at a surface of the roller main body 210 of the pressure roller 21 is defined. The pressure roller 21 is the same as in the first embodiment in layer structure, layer material, and longitudinal shape, and hence their descriptions are omitted.

In order to examine the effect according to the second embodiment, as in the first embodiment, the microhardness at the surface of the roller main body of the pressure roller was varied to verify whether or not wrinkles were formed and to perform an experiment for examining the sheet open amount and sheet conveying properties.

Also in this embodiment, carbon fibers (fiber length: 250 μm) are contained in the high hardness layer 21*c*. However, the microhardness at the surface of the roller main body is adjusted not by adjusting the microhardness of the high hardness layer 21*c* itself but changing the amount of carbon fibers (fiber length: 250 μm) to be contained in the high hardness layer 21*c*.

Figure 11:
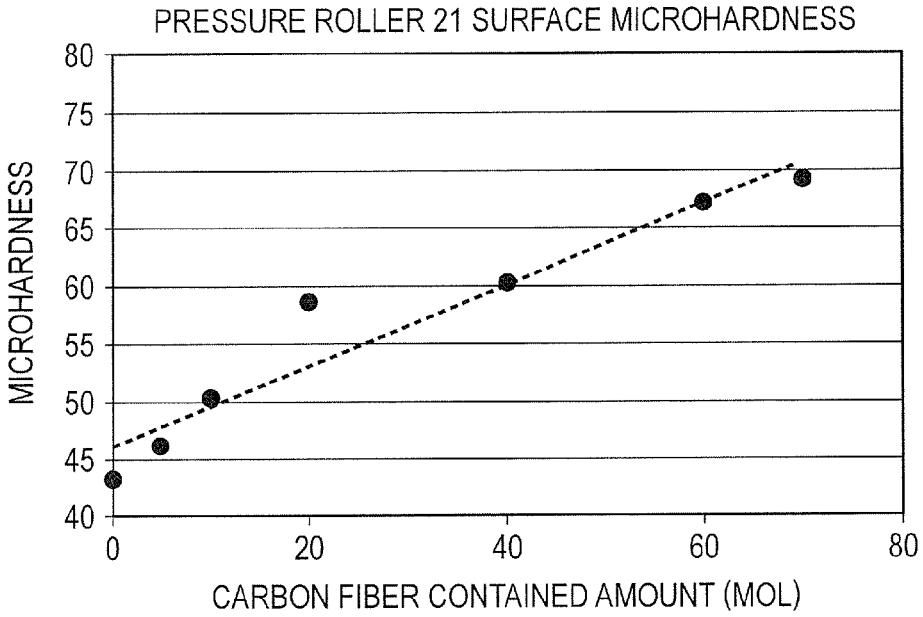
FIG. 11 is a graph for showing a relationship between a microhardness at a surface of a pressure roller according to a second embodiment of the present invention and a carbon fiber contained amount.

A relationship between the microhardness at the surface of the roller main body used in this embodiment and the carbon fiber contained amount is shown in FIG. 11. The microhardness at the surface of the roller main body is increased more as the carbon fiber contained amount in the high hardness layer 21*c* becomes larger. More specifically, the surface of the roller main body is an outer peripheral surface of the release layer 21*d* formed on an outer periphery of the high hardness layer 21*c*, but the surface hardness of the roller main body to be measured is closely related to the high hardness layer 21*c*. As understood from the graph, the microhardness at the surface of the roller main body increases to about 60 degrees when the carbon fiber contained amount is about 20 mols.

The microhardness at the surface of the roller main body and wrinkle evaluation results (evaluation results in the second embodiment as to whether or not wrinkles were formed) are shown in Table 3.

An evaluation result of the pressure roller 71 using the solid rubber (shape: same reverse camber shape as in the second embodiment, thickness in the middle portion in the longitudinal direction of the elastic layer 71*b*: 3.5 mm, no high hardness layer was formed, the release layer 71*c* was formed, microhardness at the surface of the pressure roller 71: 56 degrees) is also shown as Comparative Example 2.

As understood from the wrinkle evaluation results of Table 3, cases where the microhardness at the surface of the roller main body was 50 degrees or more were all rated as PASS, and cases where the microhardness was 48 degrees or less were all rated as FAIL. As understood from those results, formation of wrinkles can be suppressed at a microhardness of 50 degrees or more.

TABLE 3

| MICROHARDNESS | EVALUATION RESULT |
|---|---|
| 42 | FAIL |
| 46 | FAIL |
| 48 | FAIL |
| 50 | PASS |
| 53 | PASS |
| 58 | PASS |
| 61 | PASS |
| COMPARATIVE EXAMPLE 2 | PASS |

Figure 12:
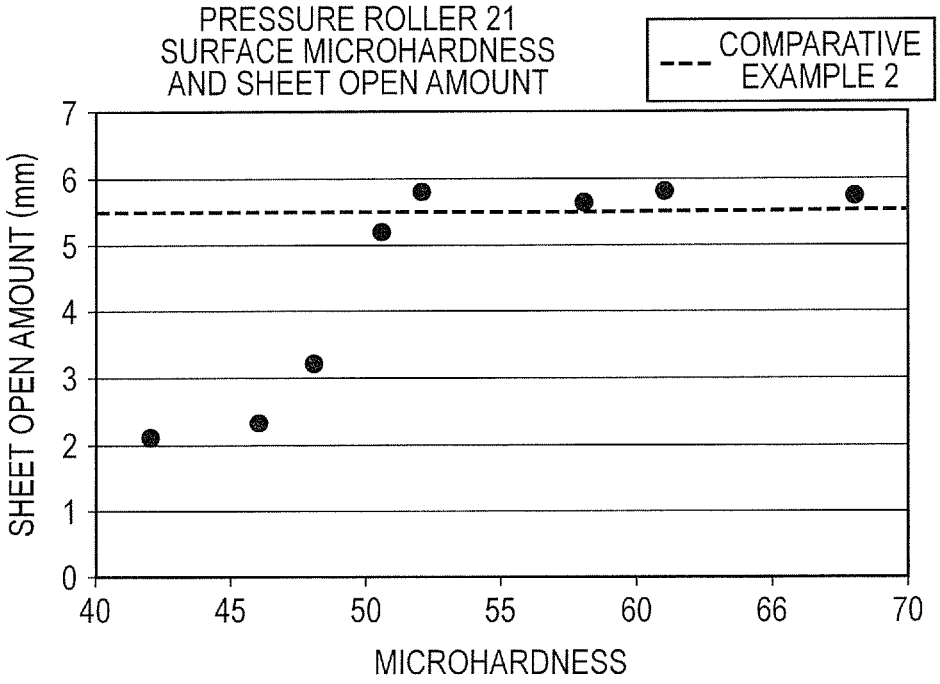
FIG. 12 is a graph for showing sheet open amount measurement results according to the second embodiment.

Next, measurement results obtained by performing measurement according to the same method as in FIG. 9 about a relationship between the microhardness at the surface of the roller main body and the sheet open amount are shown in FIG. 12.

As understood from those results, the sheet open amount is increased more as the microhardness becomes higher, and the sheet open amount sharply increases in the vicinity of 50 degrees or more. The sheet open amount in Comparative Example 2 indicated by a broken line in the graph is 5.8 mm and is substantially equivalent to that at the microhardness of 50 degrees or more. Thus, it can be understood that when the microhardness is 50 degrees or more, a difference in recording material conveyance force between the middle and the end portions in the longitudinal direction of the pressure roller is obtained to the extent that wrinkles can be suppressed.

As described above, as understood from the results shown in Table 3 and FIG. 12, the wrinkle-suppressing effect is obtained at a microhardness of 50 degrees or more. However, when the microhardness is high, as in the first embodiment, there is a risk of reduction of sheet conveyance force.

Results of slippage examined when the microhardness was varied are shown in Table 4 (examination results of sheet conveying properties in the second embodiment).

As for the examination method, as in the above-mentioned first embodiment, a sheet which was left in an environment of a temperature of 32 degrees C. and a humidity of 85% for 48 hours (basis weight: 60 g/m$^2$, product name: GF-600, Canon Inc.) was caused to pass through the fixing device. Cases where the sheet was able to be conveyed without slippage were rated as PASS, and cases where the sheet was not able to be conveyed because of slippage were rated as FAIL.

As understood from the results, slippage occurs with the pressure roller 21 having a microhardness of 68 degrees or more at the surface of the pressure roller 21.

TABLE 4

| MICROHARDNESS | EVALUATION RESULT |
|---|---|
| 50 | PASS |
| 53 | PASS |
| 58 | PASS |
| 61 | PASS |
| 65 | PASS |
| 68 | FAIL |
| 72 | FAIL |

From the above-mentioned results, when the microhardness at the surface of the roller main body of the pressure roller 21 is more than 65 degrees, the gripping force decreases and slippage occurs. Therefore, the microhardness at the surface of the roller main body is desirably 65 degrees or less.

It can be verified from the results of Table 3 and Table 4 that the microhardness at the surface of the roller main body is desirably in a range of about 50 degrees or more and 65 degrees or less, and the pressure roller 21 can suppress wrinkles of the recording material without any problem when the microhardness is in this range.

The high hardness layer 21*c* is formed to adjust the microhardness at the surface of the roller main body of the pressure roller 21 according to the second embodiment, but the release layer 21*d* may be hardened to increase the microhardness. More specifically, the microhardness at the surface of the roller main body of the pressure roller 21 can be adjusted by increasing the thickness of the release layer 21*d* or by adding a fiber-based filler such as carbon fiber when the release layer 21*d* is a thin film.

It is not necessary to form the high hardness layer 21*c* when the microhardness at the surface of the pressure roller 21 is 50 degrees or more and 65 degrees or less. The same operations and effects as described above are obtained when the release layer 21*d* is hardened. Therefore, its description is omitted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-121103, filed Jun. 16, 2015, which is hereby incorporated by reference herein in its entirety.

What is claimed is:

1. A roller for use in a fixing device, the roller comprising:
- a metal core;
- a first elastic layer formed on an outer side of the metal core, the first elastic layer having voids; and
- a second elastic layer formed on an outer side of the first elastic layer, the second elastic layer having a microhardness higher than a microhardness of the first elastic layer,
- wherein an outer diameter of an end portion of the roller is larger than an outer diameter of a middle portion of the roller in a longitudinal direction of the roller, and
- wherein the microhardness of the second elastic layer is 25 points to 50 points, as measured by an MD-1 hardness tester.

2. The roller according to claim 1, further comprising a surface layer formed on an outer side of the second elastic layer,
- wherein the second elastic layer comprises an adhesive layer configured to bond the surface layer and the first elastic layer to each other.

3. The roller according to claim 1, wherein the second elastic layer has a uniform thickness in the longitudinal direction.

4. The roller according to claim 1, wherein a surface of the roller has a microhardness of 50 points to 65 points, as measured by the MD-1 hardness tester.

5. The roller according to claim 1, wherein the second elastic layer contains a fibrous filler.

6. A fixing device configured to heat, at a nip portion, a recording material being conveyed and having a toner image formed thereon so as to fix the toner image onto the recording material, the fixing device comprising:
- a heating member to be brought into contact with the toner image; and
- a roller forming the nip portion with the heating member,
- the roller having a larger outer diameter in a longitudinal direction of the roller in an end portion than in a middle portion,
- the roller comprising:
  - a metal core;
  - a first elastic layer formed on an outer side of the metal core; and
  - a second elastic layer formed on an outer side of the first elastic layer,
- wherein the first elastic layer comprises a layer having voids, and
- wherein the second elastic layer has a microhardness of 25 points to 50 points, as measured by an MD-1 hardness tester.

7. The fixing device according to claim 6, further comprising a surface layer formed on an outer side of the second elastic layer,
- wherein the second elastic layer comprises an adhesive layer configured to bond the surface layer and the first elastic layer to each other.

8. The fixing device according to claim 6, wherein the second elastic layer has a uniform thickness in the longitudinal direction.

9. The fixing device according to claim 6, wherein a surface of the roller has a microhardness of 50 points to 65 points, as measured by the MD-1 hardness tester.

10. The fixing device according to claim 6, wherein the second elastic layer contains a fibrous filler.

11. The fixing device according to claim 1, wherein the first elastic layer is formed by a silicone rubber containing resin microballoons.

12. The fixing device according to claim 6, wherein the first elastic layer is formed by a silicone rubber containing resin microballoons.

13. The fixing device according to claim 1, wherein the microhardness of the second elastic layer is such that there is substantially no change in a circumferential length of the roller when pressure is applied to the roller.

14. The fixing device according to claim 6, wherein the microhardness of the second elastic layer is such that there is substantially no change in circumferential length of the roller when pressure is applied to the roller.

* * * * *